US008095032B2

(12) United States Patent
Torimaru et al.

(10) Patent No.: US 8,095,032 B2
(45) Date of Patent: Jan. 10, 2012

(54) IMAGE FORMING APPARATUS WITH CLEANING MEMBER

(75) Inventors: Yuusuke Torimaru, Toride (JP); Ryuta Ai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 378 days.

(21) Appl. No.: 12/361,994

(22) Filed: Jan. 29, 2009

(65) Prior Publication Data

US 2009/0190951 A1 Jul. 30, 2009

(30) Foreign Application Priority Data

Jan. 30, 2008 (JP) ..... 2008-018727

(51) Int. Cl.
*G03G 15/16* (2006.01)
*G03G 15/00* (2006.01)

(52) U.S. Cl. ..... 399/101; 399/71

(58) Field of Classification Search ..... 399/71, 399/98, 99, 101, 343, 346
See application file for complete search history.

(56) References Cited

U.S. PATENT DOCUMENTS 6,175,711 B1 1/2001 Yoshino et al.
6,459,865 B2 * 10/2002 Kusayanagi ..... 399/101
6,687,473 B2 * 2/2004 Wang et al. ..... 399/99
7,251,433 B2 7/2007 Ai et al.
7,260,341 B2 * 8/2007 Chang ..... 399/99
7,313,343 B2 * 12/2007 Tanaka et al. ..... 399/101
7,480,470 B2 1/2009 Ai
2005/0276620 A1 12/2005 Omata
2007/0116483 A1 * 5/2007 Kobayashi et al. ..... 399/346 X
2007/0242972 A1 10/2007 Ai

FOREIGN PATENT DOCUMENTS

JP 2000-187405 A 7/2000
JP 2002-14589 A 1/2002
JP 2002-229344 A 8/2002
JP 2004-347662 A 12/2004
JP 2005-242009 A 9/2005
JP 2005-352041 A 12/2005
JP 2006-208996 A 8/2006
JP 2006-276065 A 10/2006
JP 2007-79069 A 3/2007
JP 2007-232748 A 9/2007
JP 2007-240673 A 9/2007
JP 2007-304335 A 11/2007

* cited by examiner

*Primary Examiner* — Sandra Brase
(74) *Attorney, Agent, or Firm* — Fitzpatrick, Cella, Harper & Scinto

(57) ABSTRACT

When a switch displayed on an operation panel is operated, a control portion starts aging control in which image formation is stopped and yellow toner is applied onto an intermediary transfer belt and a secondary transfer roller. A toner band is formed, on full circumference of the intermediary transfer belt at a position in which toner images for control are formed, with a width correspondingly to widths of the toner images for control.

6 Claims, 7 Drawing Sheets

IMAGE FORMING APPARATUS WITH CLEANING MEMBER

FIELD OF THE INVENTION AND RELATED ART

The present invention relates to an image forming apparatus including a transfer member cleaning device for electrostatically adsorbing and removing a toner image for control transferred onto a transfer member. Specifically, the present invention relates to control for restoring a cleaning performance of the transfer member cleaning device for the transfer member.

An image forming apparatus including a transfer portion at which a toner image is transferred onto a recording material by rotating a transfer member in contact with an image bearing member such as a photosensitive drum or in contact with an image carrying member such as an intermediary transfer belt has been widely used.

Further, an image forming apparatus in which a toner image for control (control image) not to be transferred onto a recording material is formed in an area between toner images for an image to be transferred onto the recording material and is carried on an image carrying member to adjust a toner image forming condition or the like has been put into practical use.

Further, an image forming apparatus for obviating backside contamination of a recording material by rotating a cleaning member such as a fur brush in contact with a transfer member to electrostatically adsorption-remove a toner image for control deposited on the transfer member at a transfer portion has also been put into practical use.

JP-A 2005-352041 discloses an image forming apparatus in which an electrostatic cleaning device is provided to a secondary transfer roller for forming a transfer portion, rotating in contact with an intermediary transfer belt. The electrostatic cleaning device rubbing-rotates an electroconductive roller brush, to which a voltage of an opposite polarity to a charge polarity of a toner image is applied, in contact with the secondary transfer roller to electrostatically adsorption-remove a toner image for control which has been transferred onto the secondary transfer roller at the transfer portion.

The electrostatic cleaning device changes in cleaning performance depending on a balance between an electrostatic adsorption ability of the cleaning member to which a cleaning voltage is applied and a depositing force of toner on the surface of the transfer member. When a toner collecting performance of the cleaning member is lowered or a toner binding force of the surface of the transfer member is increased, the cleaning performance of a transfer member cleaning device for the transfer member is lowered. Further, when the cleaning performance of the transfer member cleaning device is lowered, the toner image for control transferred onto the transfer member cannot be sufficiently removed, so that the backside contamination of the recording material attributable to the toner image for control or density non-uniformity of a backside image during printing on both sides is liable to occur. For example, the backside contamination of the recording material or the like is liable to occur in the cases of continuous formation of an image having a small image ratio, continuous image formation on a recording material increased in transfer voltage or on a recording material having a special surface property, and an image forming job frequently repeated with a small print number. These phenomena are noticeable in a predetermined period after the image carrying member or the transfer member is replaced with new one.

In these cases, as described later, an electric discharge product covers the surface of the transfer member to increase a binding force to toner or covers the surface of the cleaning member to lower the toner collecting ability of the transfer member cleaning device.

SUMMARY OF THE INVENTION

A principal object of the present invention is to provide an image forming apparatus capable of efficiently restore a cleaning performance of a transfer member cleaning device for a toner image for control.

According to an aspect of the present invention, there is provided an image forming apparatus, comprising:

an image carrying member;

toner image forming means, for forming a toner image on the image carrying member, capable of forming an adjusting toner image for adjusting a toner image forming condition;

a transfer member, contactable to the image carrying member, for forming a transfer portion for transferring the toner image from the image carrying member onto a recording material;

a transfer power source for forming an electric field at the transfer portion;

a cleaning member, contactable to the transfer member, for electrostatically removing toner on the transfer member; and an execution portion for executing a cleaning mode in which a cleaning toner image is formed in a length equal to or longer than a circumference of the image carrying member and in an area including an area in which the adjusting toner image is formed with respect to a direction perpendicular to a movement direction of the image carrying member and then the cleaning toner image is transferred onto the transfer member by the electric field formed by the transfer power source.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with reference to the drawings. The present invention can be carried out also in other embodiments in which a part or all of constitutions of the respective embodiments are replaced by their alternative constitutions so long as a toner image for being transferred onto a secondary transfer roller during non-image formation is formed.

In the following embodiments, only a principal portion concerning formation/transfer of the toner image will be described but the present invention can be carried out in various uses including printers, various printing machines, copying machines, facsimile machines, multi-function machines, and so on by adding necessary equipment, options, or casing structures.

First Embodiment

Figure 1:
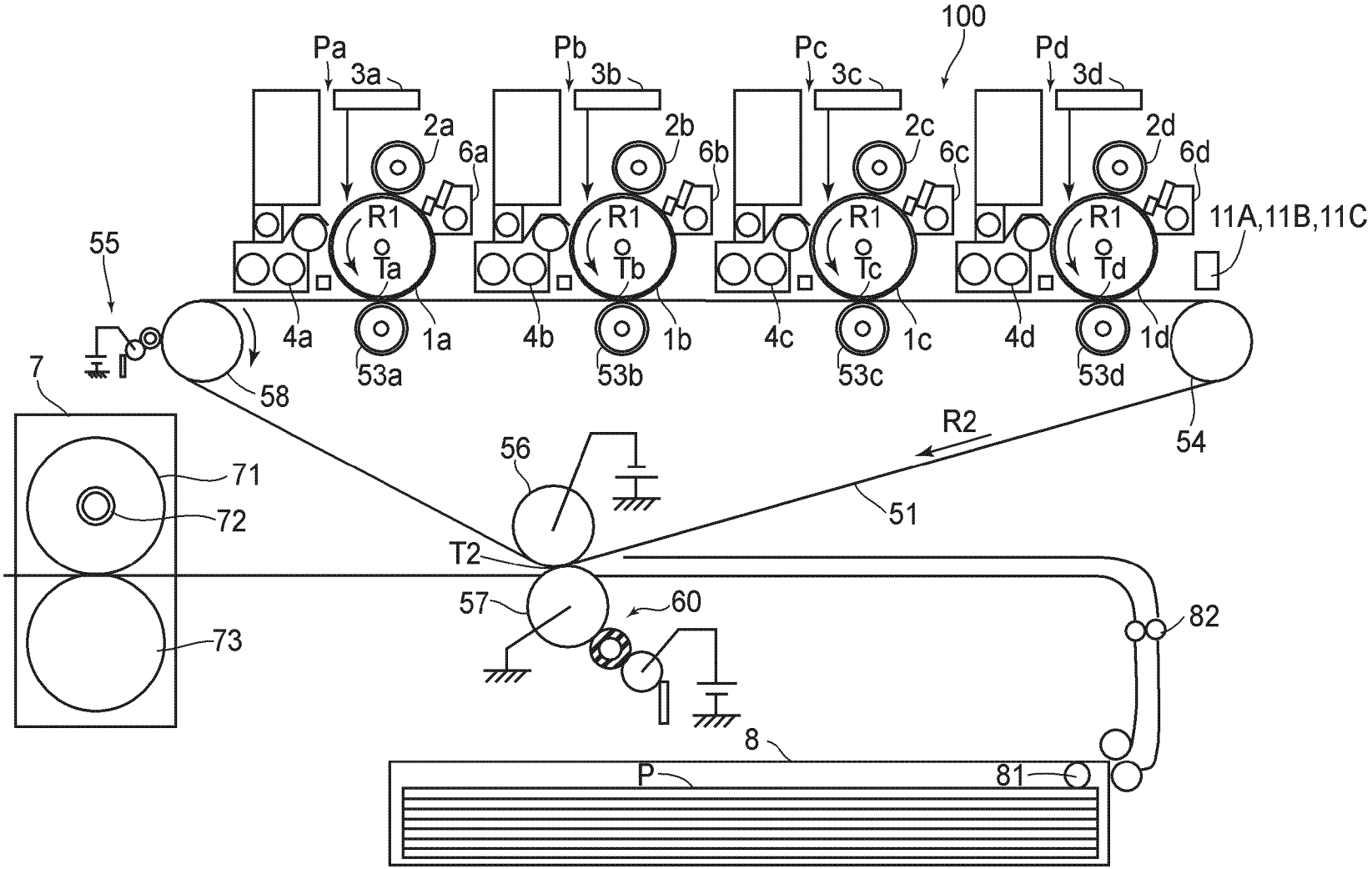
FIG. 1 is a schematic view for illustrating a structure of an image forming apparatus of First Embodiment.
Figure 2:
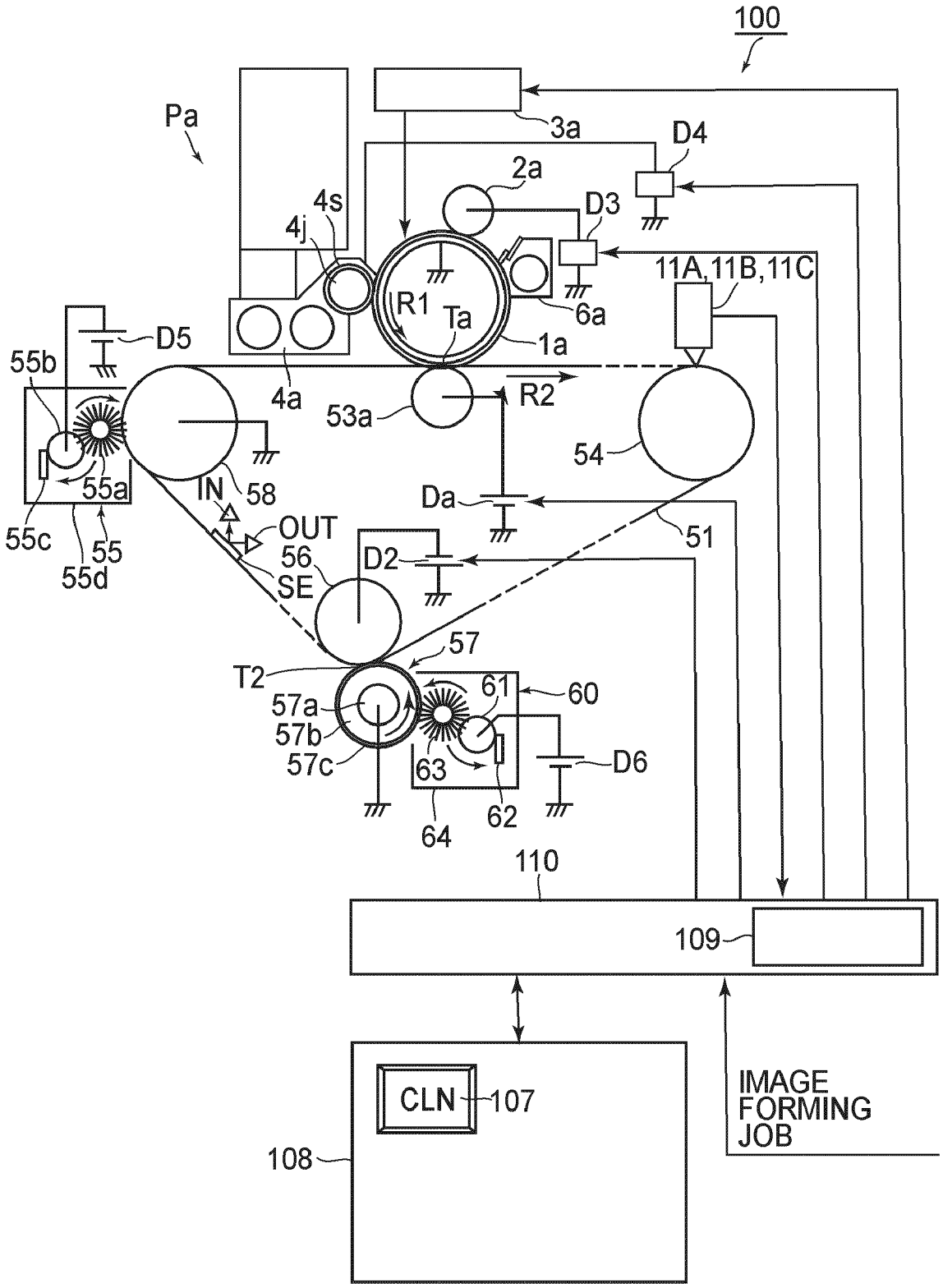
FIG. 2 is a schematic view for illustrating structures of an image forming station and a secondary transfer portion.
Figure 3:
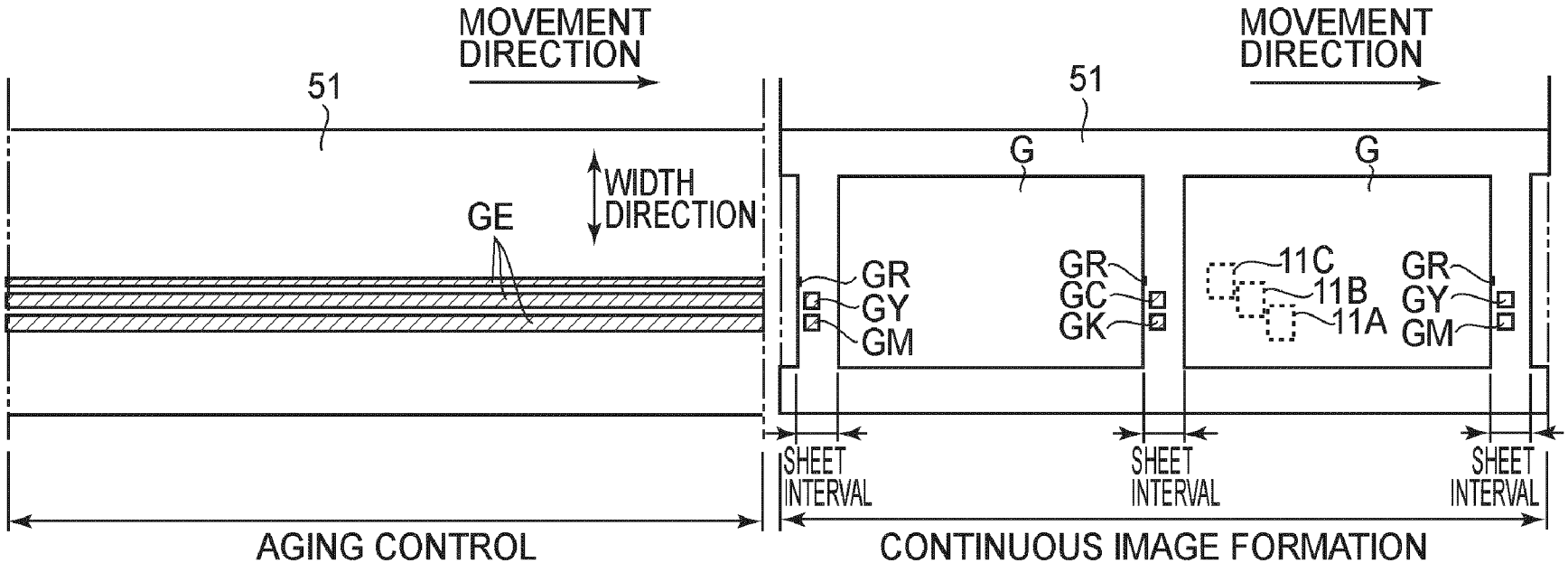
FIG. 3 is a schematic view for illustrating an arrangement of various toner images carried on an intermediary transfer belt.

FIG. 1 is a schematic view for illustrating a structure of an image forming apparatus of First Embodiment and FIG. 2 is a schematic view for illustrating structures of an image forming station and a secondary transfer portion. FIG. 3 is a schematic view for illustrating an arrangement of various toner images carried on an intermediary transfer belt.

As shown in FIG. 1, an image forming apparatus 100 of First Embodiment is a tandem-type full-color copying machine of an intermediary transfer type in which image forming stations Pa, Pb, Pc and Pd are arranged in a linear section of an intermediary transfer belt 51.

In the image forming station Pa, a yellow toner image is formed on a photosensitive drum 1*a* and then is primary-transferred onto the intermediary transfer belt 51. In the image forming station Pb, a magenta toner image is formed on a photosensitive drum 1*b* and is primary-transferred onto the yellow toner image on the intermediary transfer belt 51 in a superposition manner. In the image forming stations Pc and Pd, a cyan toner image and a black toner image are formed on photosensitive drums 1*c* and 1*d*, respectively, and are successively primary-transferred onto the magenta toner image on the intermediary transfer belt 51 in the superposition manner similarly as in the case of the image forming station Pb.

The four color toner images primary-transferred on the intermediary transfer belt 51 are conveyed to a secondary transfer portion T2, at which the toner images are collectively secondary-transferred onto a recording material P which has been fed from a recording material accommodating cassette 8 to the secondary transfer portion T2.

Registration rollers 82 as a sheet-feeding means receive the recording material P separated and fed from the recording material accommodating cassette 8 one by one, by roller 81, to place the recording material P in a stand-by, state and feeds the recording material P toward the secondary transfer portion T2 while timing the recording material P to the toner image on the intermediary transfer belt 51.

A fixing device 7 includes a fixing roller 71 and a pressing roller 73 pressed against the fixing roller 71 with a predetermined urging force. In the fixing roller 71, a heater 72 is disposed. The recording material P onto which the toner images are transferred is subjected to application of heat and pressure in a process of passing thereof through a nip between the fixing roller 71 and the pressing roller 73, so that a full-color image is fixed on the surface of the recording material P and thereafter the recording material P is discharged to the outside of the image forming apparatus 100.

(Toner Image Forming Means)

The image forming stations Pa, Pb, Pc and Pd have the substantially same constitution except that the colors of toners of yellow for a developing device 4*a* provided in the image forming station Pa, magenta for a developing device 4*b* provided in the image forming station Pb, cyan for a developing device 4*c* provided in the image forming station Pc, and black for a developing device 4*d* provided in the image forming station Pd are different from each other. In the following description, the image forming station Pa for yellow will be described and with respect to other image forming stations Pb, Pc and Pd, the suffix a of reference numerals (symbols) for representing constituent members (means) is to be read as b, c and d, respectively, for explanation of associated ones of the constituent members.

As shown in FIG. 2, the image forming station Pa includes the photosensitive drum 1*a*. Around the photosensitive drum 1*a*, a charging roller 2*a*, an exposure device 3*a*, the developing device 4*a*, a primary transfer roller 53*a*, and a drum cleaning device 6*a* are disposed in the image forming station Pa.

The photosensitive drum 1*a* is prepared by forming a photosensitive layer having a negative charge polarity at its outer peripheral surface and is rotated in a direction of an arrow at a predetermined process speed by transmitting a driving force from an unshown driving motor.

The charging roller 2*a* contacts the photosensitive drum 1*a* so that the charging roller 2*a* is rotated by the rotation of the photosensitive drum 1*a*. From a power source D3 to the charging roller 2*a*, a charging voltage in the form of a DC voltage based with an AC voltage is applied, so that the surface of the photosensitive drum 1*a* is electrically charged uniformly to a negative-polarity potential.

The exposure device 3*a* writes (forms) an electrostatic image for an image on the charged surface of the photosensitive drum 1*d* by scanning of the charged surface through a rotating mirror with a laser beam obtained by ON/OFF modulation of scanning line image data expanded from a separated color image for yellow.

The developing device 4*a* stirs two component developer so as to be electrically charged negatively and be carried on a surface of a developing sleeve 4*s* with a chain thereof created by a magnetic force of a fixed magnetic pole 4*j*, thus rubbing against the photosensitive drum 1*a* at an end of the chain of the two component developer. The developing sleeve 4*s* rotates around the fixed magnetic pole 4*j* in a direction opposite from the rotational direction of the photosensitive drum 1*a* at their contact position.

A power source D4 applies to the developing sleeve 4*s* a developing voltage in the form of a negative-polarity DC voltage biased (superposed) with an AC voltage, so that the negatively charged toner is deposited on the electrostatic image, on the photosensitive drum 1*a*, having a positive polarity relative to that of developing sleeve 4*s*. As a result, the electrostatic image is reversely developed.

The primary transfer roller 53*a* pressed the intermediary transfer belt 51 against the photosensitive drum 1*a*, thus forming a primary transfer portion Ta of the toner image between the photosensitive drum 1*a* and the intermediary transfer belt 51.

A power source Da applies a positive DC voltage to the primary transfer roller 53*a*, so that the toner image negatively charged and carried on the photosensitive drum 1*a* is primary-transferred onto the intermediary transfer belt 51 passing through the primary transfer portion Ta.

The drum cleaning device 6*a* rubs the photosensitive drum 1*a* with a cleaning blade to remove transfer residual toner which passed through the primary transfer portion Ta and remains on the surface of the photosensitive drum 1*a*.

<Image Carrying Member

The intermediary transfer belt 51 is extended around a tension roller 58, a driving roller 54 and a back-up roller 56 while being supported by these rollers, and is rotationally driven by the driving roller 54 to be rotated in a direction of an arrow R2.

The intermediary transfer belt 51 is formed of a resin material such as polyimide, polycarbonate, polyester, polypropylene, polyethylene telephthalate, acrylic resin, or vinyl chloride resin, or various rubber materials, etc.

In this embodiment, the intermediary transfer belt 51 is formed in a thickness of 0.07-0.5 mm and a circumference of 1800 mm by incorporating carbon black as an antistatic agent in an appropriate amount into the above-described materials.

The intermediary transfer belt 51 may desirably have a volume resistivity ρ of $10^5$ (ohm·cm) $\leqq \rho \leqq 10^{15}$ (ohm·cm) in view of transferability. In this embodiment, the volume resistivity ρ of the intermediary transfer belt 51 was $10^9$ (ohm·cm). The volume resistivity ρ was measured by using a problem in accordance with JIS-K6911 in an environment of 23° C. and 50% RH under a condition including an applied voltage of 100 V and an application time of 60 sec.

Transfer residual toner or the like which has passed through the secondary transfer portion T2 and has remained on the intermediary transfer belt 51 is removed by a belt cleaning device 55 as an example of an image carrying member cleaning device.

The belt cleaning device 55 applies a DC cleaning voltage of a positive polarity from a power source D5, through a metal roller 55*b*, to a fur brush 55*a* rotating in a counter direction in contact with the intermediary transfer belt 51. As a result, the fur brush 55*a* is positively charged relative to the intermediary transfer belt 51, so that the negatively charged toner deposited on the intermediary transfer belt 51 is moved to the fur brush 55*a*. Further, the metal roller 55*b* is positively charged relative to the fur brush 55*a*, so that the toner deposited on the fur brush 55*a* is moved to the metal roller 55*b*. Then, the toner carried on the metal roller 55*b* is scraped off the metal roller 55*b* by a cleaning blade 55*c* to be collected in a collecting container 55*d*.

To an inner surface of the intermediary transfer belt 51, a white seal SE is bonded. The backside surface of the intermediary transfer belt 51 in which carbon black is dispersed is black. For this reason, in the case where light is continuously emitted from a light emitting element "OUT" to the backside surface of the intermediary transfer belt 51, when the light is reflected by the seal SE, a light receiving element "IN" detects strong reflected light. By this constitution, means for detecting a position with respect to the rotational direction of the intermediary transfer belt 51 is provided. A peripheral speed of the intermediary transfer belt 51 is known, so that a position of the intermediary transfer belt 51 with respect to a circumferential direction is calculated on the basis of an elapsed time from the detection of the seal SE.

(Transfer Member)

The secondary transfer roller 57 interposes the intermediary transfer belt 51 between it and the back-up roller 56 to form the secondary transfer portion T2, for transferring the toner image onto the recording material, between the intermediary transfer belt 51 and the secondary transfer roller 57. The secondary transfer roller 57 is connected to the ground potential and the back-up roller 56 is connected to the transfer power source D2.

The transfer power source D2 applies a secondary transfer voltage in the form of a DC voltage of a negative polarity to the back-up roller 56 to secondary-transfer the toner image carried on the intermediary transfer belt 51 onto the recording material P passing through the secondary transfer portion T2.

The secondary transfer roller 57 has a structure of two or more layers including an elastic rubber layer 57*b* of an urethane rubber or the like and a coating layer 57*c* which are disposed on a metal-made central shaft 57*a*, and has a longitudinal length of 330 mm and a circumference of 75 mm. The elastic rubber layer 57*b* is a foamed layer which has a cell diameter of 0.05-1.0 mm and is formed of a rubber material in which carbon black is dispersed. The coating layer 57*c* is formed, in a thickness of 0.1-1.0 mm, of a fluorine-containing material in which an ion conductive polymer is dispersed. The secondary transfer roller 57 has a surface hardness of 35 degrees in terms of an ASKER-C hardness value.

When secondary transferability is considered, the secondary transfer roller 57 may desirably have an electric resistance R of $10^6$ ohm$\leqq$R$\leqq 10^9$ ohm. In this embodiment, the resistance R is $10^7$ ohm. The resistance R is calculated by measuring a current value when the secondary transfer roller 57 is brought into contact with a test metal roller having a diameter of 20 mm at a total pressure of 9.8N and is supplied with a DC voltage of 2 KV.

(Toner Image for Control)

In the image forming apparatus 100, control images are formed (at a sheet interval) between normal toner images to be transferred onto the recording material and then a detection result of the control images is fed back to the toner image forming condition to maintain color stability, density uniformity, and the like of the toner images. As a result, image formation with such a high image quality that a resultant image quality is a near-photographic image quality and high-speed image formation such that an image forming speed is a near-printing machine image forming speed are realized.

As shown in FIG. 3 with reference to FIG. 2, between toner images G as an image on the intermediary transfer belt 51, control images GY for yellow (Y) and GM for magenta (M) or control images GC for cyan (C) and GK for black (K) are carried on the intermediary transfer belt 51. Each of the toner images G to be transferred onto a A3-sized recording material to be longitudinally fed is continuously formed with a sheet interval of 70 mm.

Each of the control images (color particles) GY, GM, GC and GK is formed in a rectangular shape having a length of 20 mm with respect to the rotational direction of the intermediary transfer belt 51 and a width (length) of 18 mm with respect to a widthwise direction of the intermediary transfer belt 51. A density detection result of each of the control images is fed back to an amount of toner to be supplied to the developing device 4*a*.

A control image (registration patch) GR is formed in a line segment shape having a rotational direction length of 1.27 mm and a width of 10 mm with respect to the intermediary transfer belt 51. Detection timing of the control image GR is used for leading edge position detection of the toner image G.

The control images GY, GM, GC and GK are subjected to respective steps including formation of an electrostatic image, development, and primary transfer, and are carried on the intermediary transfer belt 51 at the image forming stations Pa and Pd (FIG. 1) in the same process as that of normal image formation. During continuous image formation, at the image forming stations Pa to Pd (FIG. 1), the control images GY, GM, GC and GK are formed between the toner images to be transferred onto the recording material and are primary-transferred onto the intermediary transfer belt 51.

The control images GY, GM, GC and GK are formed, in order to reduce a down time of the image forming apparatus 100, at a sheet interval between the toner images G for an image to be successively formed. The control images GY, GM, GC and GK are formed at every sheet interval between every consecutive two toner images G for the image in order to finely control a color balance of an output image.

Optical sensors 11A, 11B and 11C are disposed at positions oppositely to the driving roller 54 while shifting their positions in the widthwise direction of the intermediary transfer belt 51.

The optical sensor 11A is of a light reflection type including a light emitting portion and a light receiving portion. The optical sensor 11A detects regular (specular) reflection light by obliquely irradiating the control images GM and GK passing a portion immediately below the optical sensor 11A with infrared light and then outputs a signal corresponding to a density of the toner image to the control portion 110.

The optical sensor 11B is of a light reflection type including a light emitting portion and a light receiving portion. The optical sensor 11B detects regular (specular) reflection light by obliquely irradiating the control images GY and GC passing a portion immediately below the optical sensor 11B with infrared light and then outputs a signal corresponding to a density of the toner image to the control portion 110.

The optical sensor 11C is of a light reflection type including a light emitting portion and a light receiving portion. The optical sensor 11C detects regular (specular) reflection light by obliquely irradiating the control image GR passing a portion immediately below the optical sensor 11C with infrared light and then outputs a signal corresponding to a density of the toner image to the control portion 110.

The control portion 110 detects densities of the control images GY, GM, GC and GK from outputs of the optical sensors 11A and 11B and then adjusts an amount of toner supplied to each of the developing devices 4*a* to 4*d* for the respective colors.

The control portion 110 detects the leading edge position of the toner image for the image from an output of the optical sensor 11C and then adjusts conveyance timing of the recording material toward the secondary transfer portion T2.

The control performed by detecting the control images GY, GM, GC and GK with the optical sensors 11A and 11B is not limited to the adjustment of the amount of toner to be supplied to the developing devices.

For example, it is also possible to effect preparation of γ correction table for determining a rule for converting an inputted image signal depending on an output characteristic, an environment, and the like of the exposure device 3*a* or effect correction control. In addition, it is possible to effect control of an image forming process condition (development contrast, laser power, etc.), control of writing start timing of the electrostatic image for the image by the exposure device 3*a*, control of the transfer voltage, and the like.

The two types of the control image GR and the control images GY and GM are formed at different positions which do not overlap each other with respect to the widthwise direction of the intermediary transfer belt 51 and both have an image density in the range from 1.3 to 1.8. In this embodiment (First Embodiment), the image density is 1.5 as a reflection density corresponding to a maximum density at the image forming stations (engines) Pa and Pb. The reflection density was measured by using a reflection density meter (mfd. by X-Rite, Incorporated).

(Transfer Member Cleaning Device)

As shown in FIG. 3 with reference to FIG. 2, in the image forming apparatus 100, separation control for separating the secondary transfer roller 57 from the intermediary transfer belt 51 at the sheet interval of the recording material is not carried out.

Further, control for inverting the polarity of the secondary transfer voltage applied to the back-up roller 56 at the sheet interval of the recording material is also not carried out, so that the transfer voltage of the same polarity as that applied to the toner image G for the image is also continuously applied to the control images GY, GM and GR passing through the secondary transfer portion T2.

For that reason, the control images GY, GM and GR which are formed at the image forming stations Pa, Pb, Pc and Pd and the carried on the intermediary transfer belt 51 at the sheet interval between the toner images for the image are secondary-transferred onto the secondary transfer roller 57 during passing thereof through the secondary transfer portion T2. Then, when the control images GY, GM and GR secondary-transferred onto the secondary transfer roller 57 are left as they are, the control images are deposited on the backside surface of the recording material P which contacts the secondary transfer roller 57 to cause backside contamination or color unevenness by being superposed on a backside image during image printing on both sides in some cases.

Therefore, in the image forming apparatus 100, a transfer member cleaning device 60 is provided to the secondary transfer roller 57 and removes the control images GY, GM and GR secondary-transferred onto the secondary transfer roller 57 according to an electrostatic fur brush cleaning method.

As shown in FIG. 2, the transfer member cleaning device 60 applies a DC voltage of a positive polarity as a cleaning voltage from a power source D6 through a metal roller 61 to a fur brush 63 rotating in a counter direction in contact with the secondary transfer roller 57. As a result, the fur brush 63 is positively charged relative to the secondary transfer roller 57, so that the negatively charged toner deposited on the secondary transfer roller 57 is moved to the fur brush 63. Then, the metal roller 61 is positively charged relative to the fur brush 63, so that the toner deposited on the fur brush 63 is moved to the metal roller 61. The toner carried on the metal roller 61 is scraped off the metal roller 61 by a cleaning blade 62 to be collected in a collecting container 64.

The fur brush 63 of the transfer member cleaning device 60 is disposed downstream of the secondary transfer portion T2 along a rotational direction of the secondary transfer roller 57 with a depth of impression of 1.0 mm with respect to the secondary transfer roller 57.

The fur brush 63 has an outer diameter of 20 mm, a fur length of 5 mm, an implantation density of 500,000 fibers/inch$^2$, and an electric resistance R of $10^7$ ohm. The resistance R is a calculated value obtained from a current value measured by applying a DC voltage of 100 V to the fur brush 63 in a state in which the fur brush 63 is rotated at 100 rpm in contact with a metal roller for measurement with the depth of impression of 1.0 mm.

The fur brush 63 is rotationally driven in a direction counter to the rotational direction of the secondary transfer roller at a peripheral speed which is 20% of that of the secondary transfer roller 57.

The power source D6 outputs, to the metal roller 61, the DC voltage of the positive (+) polarity opposite to the toner charge polarity during the rotation of the fur brush 63. The cleaning blade 62 formed of an urethane rubber contacts the metal roller 61.

Incidentally, as the transfer member cleaning device 60, a cleaning device of a blade counter contact type in which a cleaning blade is disposed in contact with the secondary transfer roller with respect to the counter direction is inappropriate for the following reason.

The blade counter contact type cleaning device has a high cleaning performance in general. However, the secondary transfer roller is the elastic roller also having the function of conveying the recording material, so that a frictional force between the cleaning blade and the secondary transfer roller is excessive when the cleaning blade is brought into contact with the secondary transfer roller to the extent that the surface of the secondary transfer roller is completely cleaned. In this case, during the image formation, the frictional force between the cleaning blade and the secondary transfer roller causes a change in load to result in a difference in speed between the secondary transfer roller and the image carrying member, so that image expansion and contraction due to a change in conveyance speed and defective image such as color deviation occur. When the electric discharge product is accumulated on the secondary transfer roller, the frictional force of the secondary transfer roller with the cleaning blade is increased, so that the image expansion and contraction, the color deviation, and the like are further serious.

However, when the depth of impression of the cleaning blade with respect to the secondary transfer roller is decreased in order to decrease the frictional force, the cleaning performance is caused to lower, so that backside contamination of the recording material occurs. When the depth of impression is excessively decreased, an end of the cleaning blade is pulled toward a thrust side by the frictional force between the cleaning blade and the secondary transfer roller, so that the cleaning blade is exerted. In order to ensure a conveyance performance of the recording material, also when a surface roughness of the secondary transfer roller is increased, the cleaning performance is similarly lowered, so that the backside contamination of the recording material occurs.

Therefore, with respect to the secondary transfer roller employing the elastic roller, the electrostatic fur brush cleaning method is effective. However, in the electrostatic fur brush cleaning method, an amount of toner which can be cleaned at one time is limited, so that it is desirable that positions of the control images for the respective colors do not overlap with each other with respect to the widthwise direction of the intermediary transfer belt. The control images for the respective colors to be formed at the sheet intervals may desirably be formed at positions which are not coincide with each other with respect to the widthwise direction of the intermediary transfer belt so that their widths are decreased as small as possible within a range capable of being detected by the optical sensors.

<Electric Discharge Product>

Figure 4:
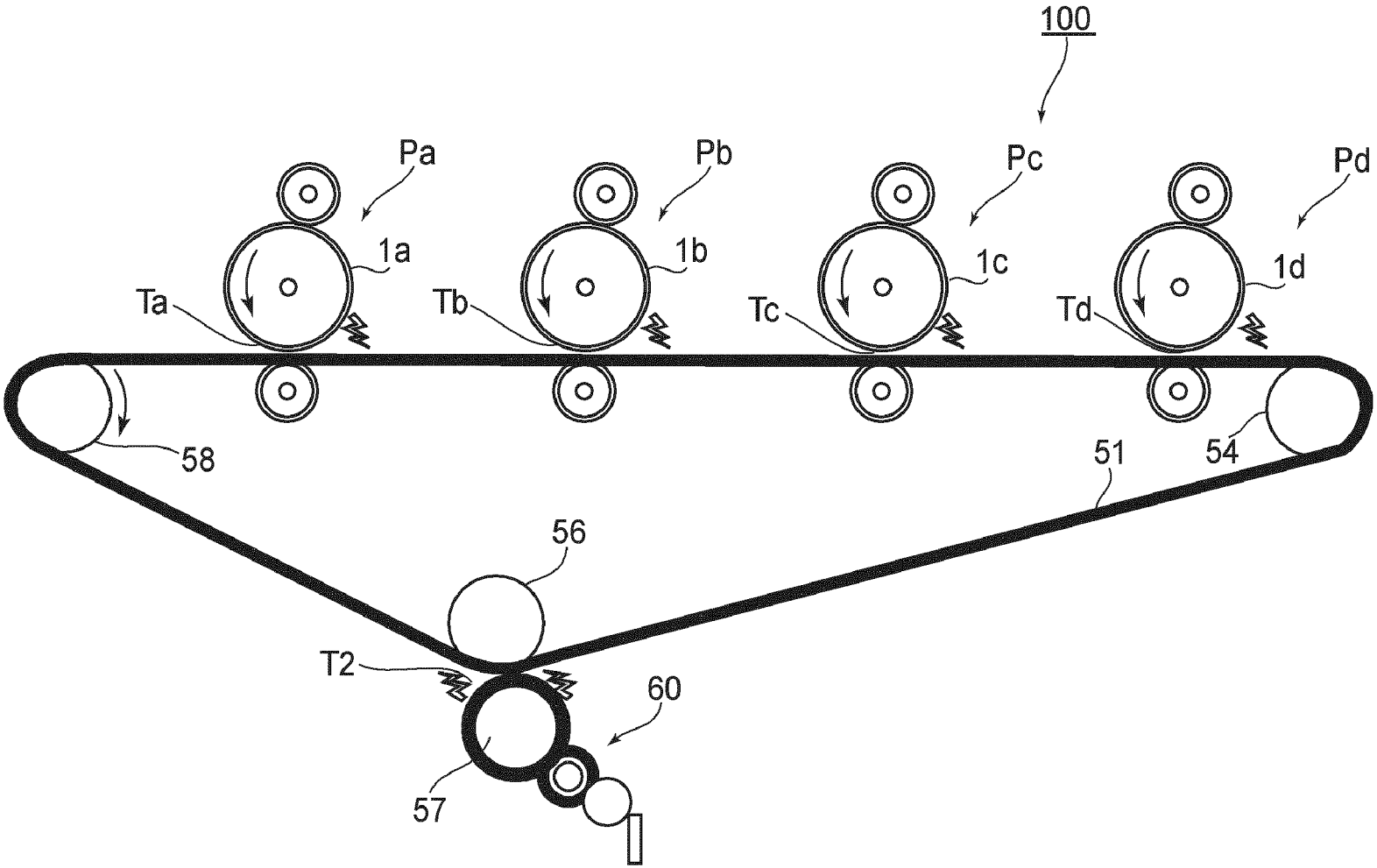
FIG. 4 is a schematic view for illustrating a state in which an electric discharge product is deposited on the intermediary transfer belt and a secondary transfer roller.

FIG. 4 is a schematic view for illustrating a state in which the electric discharge product is deposited on the intermediary transfer belt and the secondary transfer roller.

Between the transfer member and the image carrying member, the electric discharge product is generated due to the transfer current. When the electric discharge product is moved from the transfer member to the cleaning member and is accumulated on the surface of the cleaning member, a toner movement property between the transfer member and the cleaning member is gradually worsen. For this reason, after the transfer current is continuously applied to the transfer portion for a certain time, when the toner to be removed by cleaning reaches a cleaning member contact portion, defective cleaning occurs.

As shown in FIG. 2, the transfer member cleaning device 60 of the electrostatic cleaning type moves toner particles constrained at the surface of the secondary transfer roller 57 to the fur brush 63 by an electrostatic force. For this reason, when a force of constraint of the toner at the surface of the secondary transfer roller 57 is changed, the cleaning performance of the transfer member cleaning device is largely changed.

The electric discharge product generated by electric discharge caused at the secondary transfer portion T2 to which the secondary transfer voltage is applied increases the force of constraint of the toner at the surface of the secondary transfer roller 57, so that it is difficult to remove the control images by cleaning with the fur brush 63.

To the secondary transfer roller 57, in order to transfer the toner image for the image onto the recording material, a high voltage of 1000 V to 4000 V is applied as the secondary transfer voltage. At a high voltage-applied portion between the intermediary transfer belt 51 (or the recording material) and the secondary transfer roller 57, an electric discharge phenomenon occurs to cause reaction with nitrogen or the like in the ambient air, so that an electric discharge product represented by NOx is generated.

When the electric discharge product is deposited, the force of constraint of the toner particles at the surface of the secondary transfer roller 57 is increased, so that the toner particles which cannot be adsorbed are increased.

As a result, the high-density control images secondary-transferred onto the secondary transfer roller 57 are not removed sufficiently by one-time rubbing with the fur brush 63 and are carried and moved by the secondary transfer roller 57 to deposit on the backside surface of the recording material passing through the secondary transfer portion T2. As a result, the backside contamination of the recording material or the color unevenness of the backside image during the printing on both sides occurs.

According to study described above, it has been found that the electric discharge product is removed by causing the recording material to pass through the secondary transfer portion T2 or by applying the toner onto the secondary transfer roller 57, so that the cleaning performance of the transfer member cleaning device 60 for the control images can be restored.

This is because the surface of the recording material (paper) scrapes and takes the electric discharge product off the surface of the secondary transfer roller 57 by rubbing. Further, the external additive deposited on the toner surface scrapes the electric discharge product off the secondary transfer roller 57 as abrasive particles, so that the scraped electric discharge product is taken away together with the toner.

However, it has been confirmed that the cleaning performance of the transfer member cleaning device for the control images cannot be sufficiently restored by only removal of the electric discharge product from the surface of the secondary transfer roller 57.

As shown in FIG. 4, in the image forming apparatus 100, the electric discharge phenomenon occurs at not only the secondary transfer portion T2 but also the primary transfer portions Ta, Tb, Tc and Td of the image forming stations Pa, Pb, Pc and Pd. The electric discharge products generated at the primary transfer portions Ta, Tb, Tc and Td are moved to the secondary transfer roller 57 at the secondary transfer portion T2 to lower the cleaning performance of the transfer member cleaning device for the secondary transfer roller 57.

A circumference (peripheral length) of the intermediary transfer belt 51 is incomparably longer than that of the secondary transfer roller 57, so that the electric discharge product deposited on the intermediary transfer belt 51 is concentrated and deposited on the secondary transfer roller 57, so that the backside contamination due to the control images occurs again in a short time. Particularly, in an initial state of the intermediary transfer belt as the image carrying member, i.e., for sometime after replacement of the intermediary transfer belt with new one, the backside contamination attributable to the control images is particularly liable to occur.

This is because, with cumulative image formation, an amount of the external additive which is deposited on the surface of the intermediary transfer belt 51 and functions as a spacer between the intermediary transfer belt 51 and the secondary transfer roller 57 is small, so that the electric discharge product is liable to move to the secondary transfer roller 57 at the secondary transfer portion.

<Cleaning Mode>

As shown in FIG. 3 with reference to FIG. 2, the control portion 110 is capable of executing control of a cleaning mode (aging control) in which a toner band GE is formed at timing other than that of image formation and is applied onto the secondary transfer roller 57 and the intermediary transfer belt 51.

The control portion 110 stops normal image formation, when a switch 107 displayed on an operation panel 108 is operated, to execute the aging control, so that the backside contamination of the recording material due to the presence of the control images GY, GH, GC, GK and GR is obviated. This is because although the backside contamination of the recording material can be gradually improved by repetition of image formation on the recording material, it is necessary to quickly obviate the backside contamination on the spot in a state the backside contamination has already occurred.

However, when a detection sensor for the backside contamination is disposed downstream of the secondary transfer portion and then detects the occurrence of the backside contamination, the control portion 110 may also execute the aging control without awaiting the operation of the switch 107.

Further, it is also possible to execute the aging control automatically during the pre-rotation in a first image forming job after the replacement of the intermediary transfer belt 51 or during the above-described post-rotation in an image forming job in which the electric discharge product is liable to accumulate on the secondary transfer roller 57.

The toner band GE has a length, with respect to a widthwise direction perpendicular to the rotational direction of the image carrying member 51, shorter than the normal toner image G and is formed on the entire circumferential surface at positions corresponding to those of the toner images for control GY, GM and GR on the image carrying member 51. The toner band GE is subjected to the respective steps of formation of the electrostatic image, development, and primary transfer in the same image forming process as that for normal image formation at the image forming station Pa, thus being carried on the entire circumferential surface.

The reason why the toner band GE is formed with the yellow toner is that the backside contamination of the recording material is less conspicuous compared with other toners such as the black toner even when image formation is started in a state in which the toner band GE remains on the secondary transfer roller 57. Therefore, in the case where a developing device using white toner or transparent toner is provided, the toner band GE is formed with the white toner rather than the yellow toner and with the transparent toner rather than the white toner. That is, the toner band GE may desirably be formed with toner of a color having the smallest contrast with respect to the recording material.

During a period of the aging control, the control portion 110 controls the transfer power source D2 so as to continuously output the secondary transfer voltage equal to that during the normal continuous image formation, so that the toner band GE carried on the intermediary transfer belt 51 is secondary-transferred onto the secondary transfer roller 57.

Further, during the period of the aging control, the control portion 110 controls the cleaning power source D6 so as to continuously output a cleaning voltage equal to that during the normal continuous image formation, so that the toner band GE carried on the secondary transfer roller 57 is moved to the fur brush 63.

However, the toner band GE supplies toner in a large amount exceeding that corresponding to the cleaning performance of the transfer member cleaning device 60, so that the toner stagnates on the fur brush 63 to continuously rub against the surface of the secondary transfer roller 57.

In the aging control, by supplying the toner band GE to the secondary transfer roller 57, the electric discharge product deposited on the surface of the secondary transfer roller 57 is removed to lower surface free energy. As a result, the control images GY, GM, TC, GK and GR transferred onto the secondary transfer roller 57 can be satisfactorily removed by the electrostatic cleaning.

In the toner contained in the two component developer, fine particles, which are called an external additive, having a particle size of several tens of nm to several hundreds of μm are contained. The external additive covers the entire toner particles to ensure flowability of the two component developer. Most of the external additive deposits on the toner particles as it is but a part of the external additive is separated from the toner particles to constitute a free external additive.

When the toner is applied onto the secondary transfer roller 57, the free external additive deposits on the fur brush 63 and rubs against the surface of the secondary transfer roller 57, and the external additive deposited on the secondary transfer roller 57 rubs against the surface of the fur brush 63. The external additive constituted by silica or the like functions as an abrasive substance and removes the electric discharge product deposited on the surface to be rubbed. The external additive has a particle size smaller than that of the toner and has a surface area larger than that of the toner, so that an effect of removing the electric discharge product from the surface to be rubbed is large.

Further, when the electric discharge product deposits on the fur brush 63, the force of constraint of the toner is increased to impair the transfer of the toner onto the metal roller 61, so that the toner adsorbed from the secondary transfer roller 57 stagnates on the fur brush 63 in a large amount to impair the cleaning performance.

For this reason, when the electric discharge product on the fur brush 63 is removed by rubbing between the secondary transfer roller 57 and the fur brush 63 through the toner, the toner is transferred normally onto the metal roller 61, so that the cleaning performance is restored.

The aging control not only allows restoring of the cleaning performance of the transfer member cleaning device 60 but also acceleratedly deposits the external additive on the surfaces of the intermediary transfer belt 51 and the secondary transfer roller 57.

When the surface of the secondary transfer roller 57 is surface-covered with the external additive, the external additive is interposed as spacer particles between the control images and the electric discharge product even in the case where the control images are formed on the deposited control images. For this reason, the cleaning performance of the transfer member cleaning device 60 for the control images is less liable to be impaired.

When the intermediary transfer belt 51 is surface-covered with the external additive, the external additive is interposed as spacer particles between the surface of the secondary transfer roller 57 and the electric discharge product carried on the intermediary transfer belt 51. For this reason, the electric discharge product is less liable to be transferred from the intermediary transfer belt 51 onto the secondary transfer roller 57 at the secondary transfer portion T2.

<Experiment 1>

In order to evaluate a degree of elimination of the backside contamination by forming the toner band, Experiment 1 for intentionally causing the backside contamination was performed in a state in which the backside contamination of the recording material was generated.

In Experiment 1, as the intermediary transfer belt 51, the secondary transfer roller 57 and the fur brush 63, those in an initial state were used and the backside contamination attributable to the control images was acceleratedly caused to occur by repeating an image forming job for forming an image on a single sheet. This is because, in the image forming job for forming the image on the single sheet, the electric discharge product is liable to be accumulated since a take-away ratio of the electric discharge product, by the recording material, deposited on the intermediary transfer belt 51 or the secondary transfer roller 57 during the pre-rotation before image formation is small. Further, that is because, when the intermediary transfer belt 51, the secondary transfer roller 57 and the fur brush 63 are in a brand-new condition, the amount of the external additive present as the spacer particles is small and therefore the deposition of the electric discharge product directly enhance the force of constraint of the toner.

Embodiment 1

After the completion of Experiment 1, in the state in which the backside contamination attributable to the control images was caused to occur, it was confirmed that the backside contamination attributable to the control images was eliminated by forming the toner band.

As shown in FIG. 3 with reference to FIG. 2, three toner bands GE in this embodiment were formed at positions correspondingly to positions of control images GY and GC, positions of control images GM and GK, and a position of a control image GR, respectively.

The control portion 110 controls the image forming station Pa so as to start formation of the toner bands GE with timing at which the seal SE is detected by the light-receiving element IN and then controls the image forming station Pa so as to complete the formation of the toner bands GE with timing at which the seal SE is detected three times by the light-receiving element IN. The toner band GE have a density gradation level of 255/255 and an amount of toner per unit area of 07 mg/cm$^2$ and are formed in a length corresponding to three-full circumference of the intermediary transfer belt 51 so as to cover areas in which the control images GY, GM and GR are to be formed, respectively. The toner bands GE formed at the positions correspondingly to the positions of the control images (color patches) GY and GM have a width of 20 mm. The toner band GE formed at the position correspondingly to the position of the control image (leading edge registration mark) GR has a width of 12 mm.

Thereafter, the control portion 110 causes the intermediary transfer belt 51 to stop after subjecting it to blank rotation through three full turns in a state in which the transfer voltage is not applied to the primary transfer portions Ta to Td and the secondary transfer portion T2 (i.e., in a state in which the electric discharge is stopped). This is because the belt cleaning device 55 is actuated in the state in which the electric discharge is stopped to clean the intermediary transfer belt 51 and at the same time the transfer member cleaning device 60 is actuated to clean the secondary transfer roller 57.

As described above, by forming the toner bands GE during non-image formation, the electric discharge product on the intermediary transfer belt 51 is deposited on the toner image and then is collected by the belt cleaning device 55 and the transfer member cleaning device 60. As a result, defective cleaning at the secondary transfer portion is eliminated, so that the backside contamination of the recording material attributable to the control images is not caused to occur.

In this embodiment, each of the three toner bands GE is yellow and these toner bands GE are formed in a total circumferential length corresponding to 3-full circumference of the intermediary transfer belt but these can be appropriately changed depending on a status of an occurrence of the backside contamination of the recording material, such as a circumferential length of each of the control images.

Further, in this embodiment, the length corresponding to 3-full circumference of the intermediary transfer belt was required in a first experiment. However, when a similar experiment was conducted in a second experiment and a third experiment, it was confirmed that the length of the toner band GE necessary to eliminate the backside contamination of the recording material is shorter with an increasing number of the experiments. Also from this result, it was possible to confirm an effect of aging the intermediary transfer belt 51 and the like by forming the toner bands GE during non-image formation.

Embodiment 2

Figure 5:
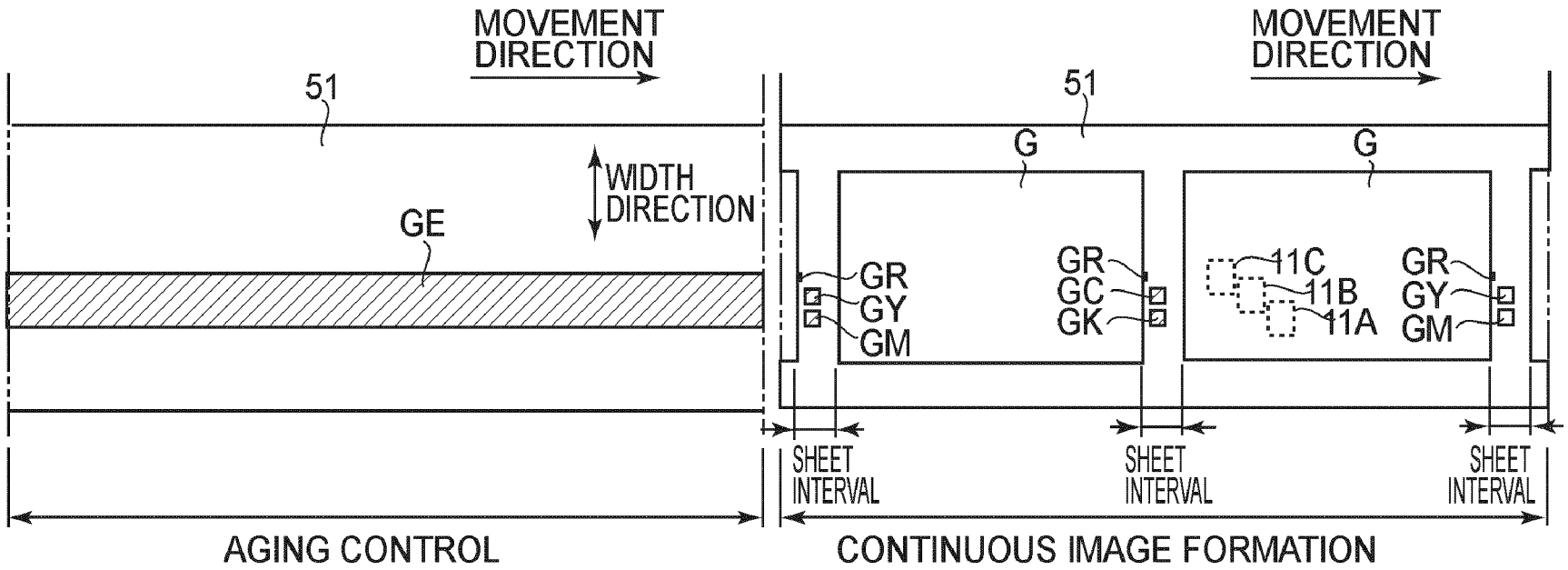
FIGS. 5 and 6 are schematic views for illustrating a toner band in aging control in Embodiments 2 and 3, respectively.

FIG. 5 is a schematic view for illustrating a toner band in aging control in Embodiment 2. A difference between Embodiment 1 and Embodiment 2 is merely the number and width of the toner bands, so that only the difference will be described in this embodiment and redundant description will be omitted.

As shown in FIG. 5 with reference to FIG. 2, the toner band GE has a density gradation level of 255/255 and an amount of toner permit area of 0.7 mg/cm$^2$ and is formed in a length corresponding to one-full circumference of the intermediary transfer belt 51 so as to cover the entire areas in which the control images GY, GM and GR are to be formed. Specifically, a single toner band GE was formed in a width of 75 mm so that the toner band GE overlaps with a range from an outer end of the control image GR (leading edge registration mark) with respect to the widthwise direction of the intermediary transfer belt 51 to an outer end of the control image (color path) GM with respect to the widthwise direction of the intermediary transfer belt 51.

Also by the aging control in Embodiment 2, similarly as in Embodiment 1, defective cleaning at the secondary transfer portion T2 was eliminated, so that the backside contamination of the recording material attributable to the control images was not caused to occur in an image forming job subsequently performed.

Embodiment 3

Figure 6:
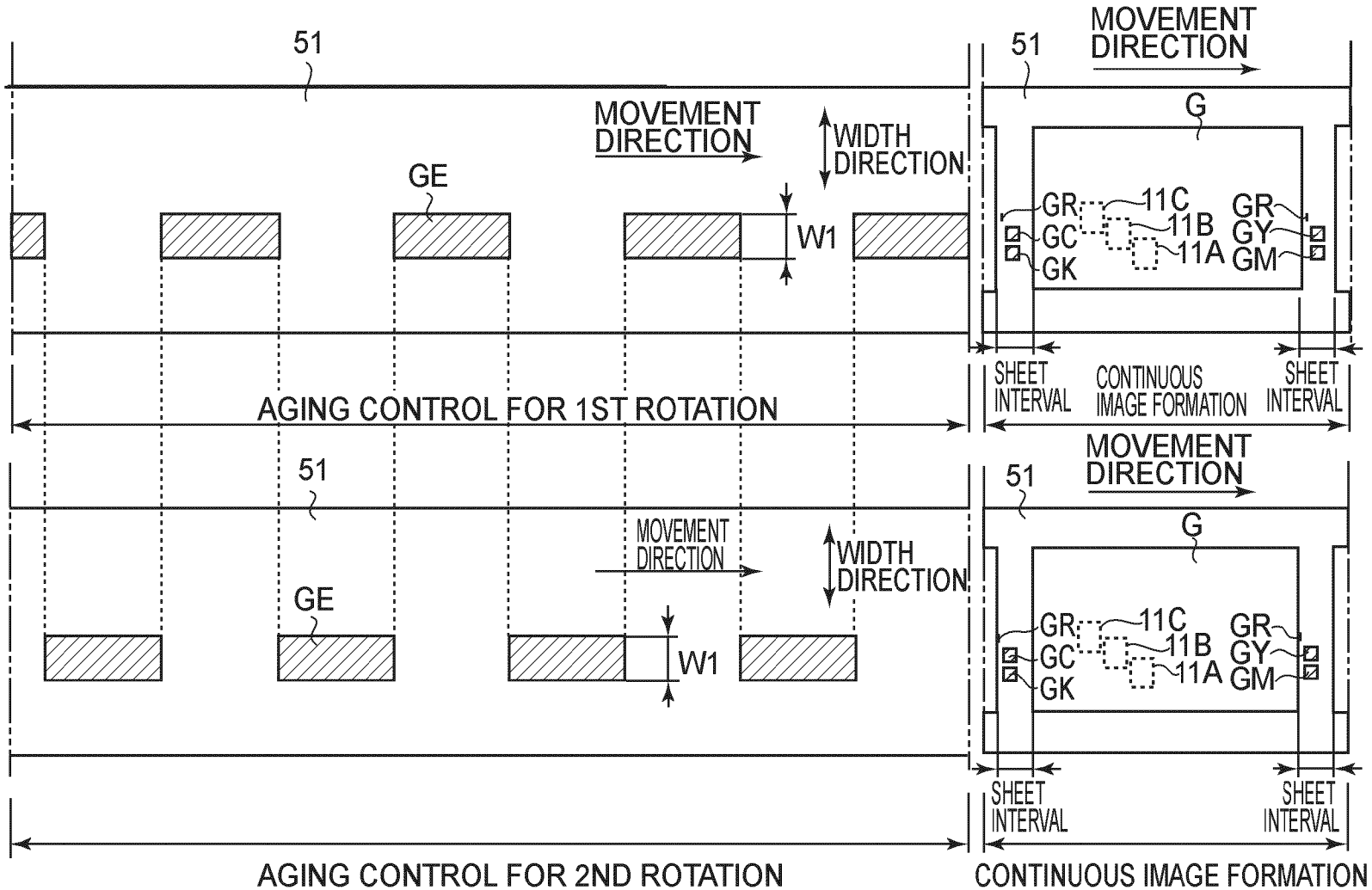

FIG. 6 is a schematic view for illustrating a toner band in aging control in Embodiment 3. A difference between Embodiment 2 and Embodiment 3 is merely the length and arrangement of the toner band, so that only the difference will be described in this embodiment and redundant description will be omitted.

As shown in FIG. 6 with reference to FIG. 2, toner bands GE have a density gradation level of 255/255 and an amount of toner permit area of 0.7 mg/cm$^2$ and are intermittently formed in a length corresponding to two-full circumference of the intermediary transfer belt 51 in areas in which the control images GY, GM and GR are to be formed. Specifically, a plurality of toner band portions GE was formed in a width W1 of 75 mm so that the toner band GE overlaps with a range from an outer end of the control image GR (leading edge registration mark) with respect to the widthwise direction of the intermediary transfer belt 51 to an outer end of the control image (color path) GM with respect to the widthwise direction of the intermediary transfer belt 51 and was formed in a length of 225 mm with an interval of 225 mm with respect to a rotational direction of the intermediary transfer belt 51.

The length of 225 mm of each of the toner band portions GE corresponds to three times a circumference (peripheral length) of 75 mm for the secondary transfer roller 57 as an example of an integral multiple of the circumference of the secondary transfer roller 57, so that the toner is uniformly applied onto the entire circumferential surface of the secondary transfer roller 57 when the toner band portions are secondary-transferred from the intermediary transfer belt 51 onto the secondary transfer roller 57 at the secondary transfer portion T2. Further, on the intermediary transfer belt 51 passed through the secondary transfer portion T2, deposition of toner (decreased in charge amount or intended in charge polarity) transferred from the secondary transfer roller 57 was observed in an area including portions corresponding to intervals between adjacent toner band portions GE. It was confirmed that this toner had an effect of applying the external additive onto the intermediary transfer belt 51 by being rubbed with the fur brush 55*a* of the belt cleaning device 55.

A phase of the intervals of the toner band portions GE was inverted between a first full turn started with timing at which the seal SE is first detected by the light-receiving element IN and a second full turn started with timing at which the seal SE is detected two times by the light-receiving element IN. That is, at the position in which the toner band was firmed in the first full turn, the interval between the toner bands was provided in the second full-turn and the position in which the interval was provided in the first full turn, the toner band was formed in the second full turn.

For this reason, although the toner band portions GE are formed intermittently, averaging of an amount of application of the toner is realized over the entire circumferential surface.

Also by the aging control in Embodiment 3, similarly as in Embodiment 1, defective cleaning at the secondary transfer portion T2 was eliminated, so that the backside contamination of the recording material attributable to the control images was not caused to occur in an image forming job subsequently performed.

Embodiment 4

Embodiment 4 is the same as Embodiment 1 except for starting timing of the aging control, so that a difference in starting timing of the aging control from Embodiment 1 will be described and redundant description will be omitted.

In Embodiment 1, the aging control was started by the operation of the switch 107 of the operation panel 108 by the user or a service person. On the other hand, in Embodiment 4, an aging mode is automatically executed during the pre-rotation in first image formation after information on replacement of the intermediary transfer belt 51 with new one is detected and then the intermediary transfer belt 51 is replaced.

The control portion 110 counts the number of cumulative sheets subjected to image formation in the image forming apparatus 100 and displays warming requiring the replacement of the intermediary transfer belt 51 on the operation panel 108 when the number of the cumulative sheets reaches a predetermined value ($5000\times10^3$ sheets). After the warning display, when an increase in glassiness of the intermediary transfer belt 51 to a value not less than a certain value is detected on the basis of outputs of the optical sensors 11A, 11B and 11C, the control portion 110 judges that the intermediary transfer belt 51 has been replaced with new one and resets the number of the cumulative sheets and then executes the aging mode.

Specifically, a value of glossiness of the intermediary transfer belt 51 measured by the service person with a handy glossimeter ("PG-1", mfd. by NIPPON DENSHOKU INDUSTRIES CO., LTD.) (which provides a value of 60 at an incident angle of 75 degrees) during pre-shipment adjustment is written in a storing device 109.

Further, measurement results of regular (specular) reflection light from the intermediary transfer belt 51 detected by the optical sensors 11A, 11B and 11C during actuation of a main assembly of the image forming apparatus 100 are also stored in the storing device 109 correspondingly to the glossiness value. Then, the replacement of the intermediary transfer belt 51 is judged by comparing the glossiness of the intermediary transfer belt 51 during the main assembly actuation with the glossiness during the pre-shipment adjustment stored in the storing device 109.

Second Embodiment

Figure 7:
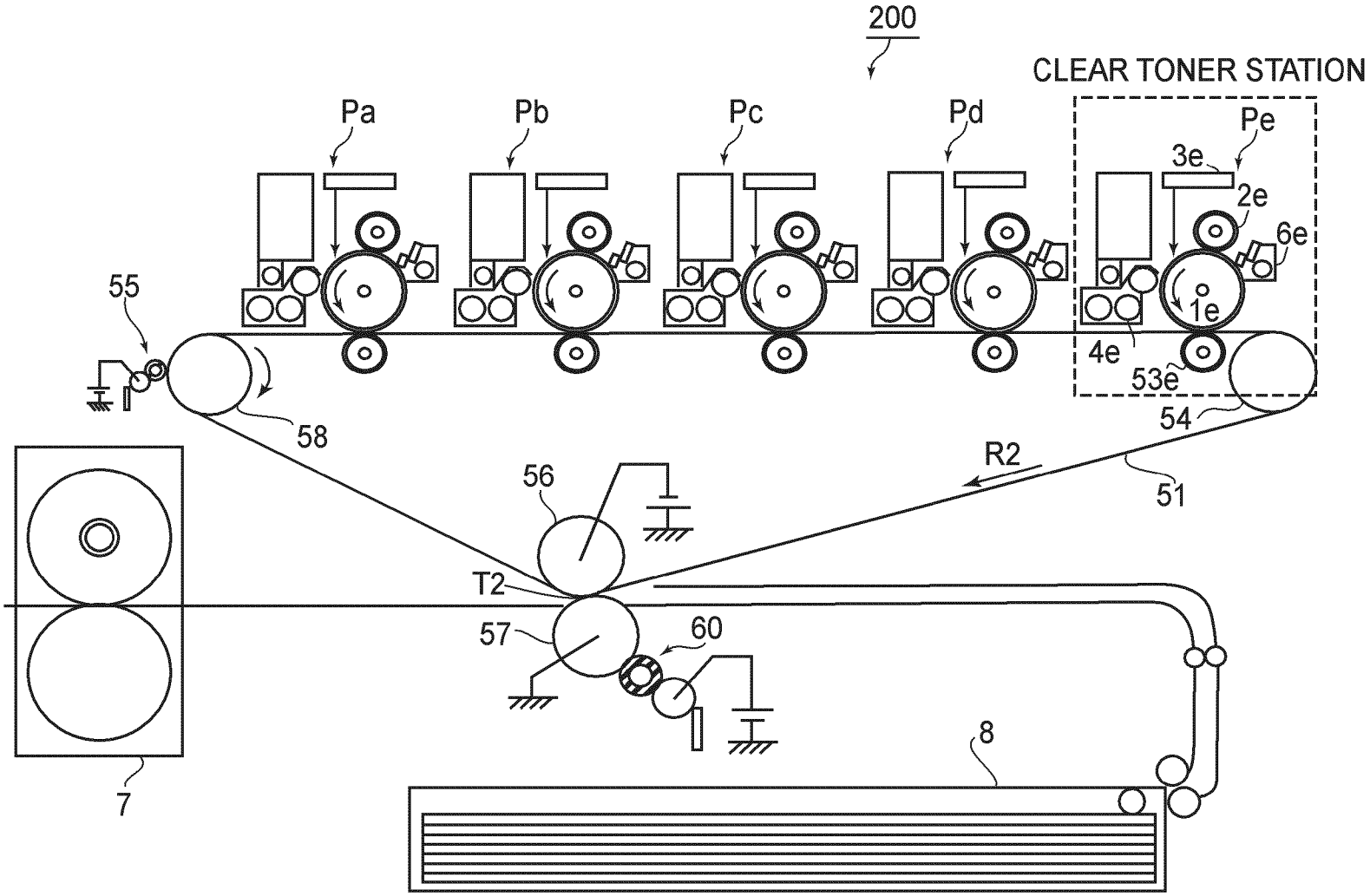
FIG. 7 is a schematic view for illustrating a structure of an image forming apparatus of Second Embodiment.

FIG. 7 is a schematic vie for illustrating a structure of an image forming apparatus of Second Embodiment. An image forming apparatus 200 of this embodiment executes the aging control in the same manner as in Embodiment 1 using the image forming apparatus 100 of First Embodiment except that the toner bands GE are formed with a clear toner. Therefore, in this embodiment, the difference from First Embodiment will be described and redundant description will be omitted.

As shown in FIG. 7, the image forming apparatus 200 of Second Embodiment is a tandem type full-color copying machine of an intermediary transfer type in which image forming stations Pa, Pb, Pc, Pd and Pe are arranged in a linear section of an intermediary transfer belt 51.

At the image forming station Pe, a clear toner image is formed on a photosensitive drum 1*e* and is primary-transferred onto toner images of yellow, magenta, cyan and black which have been carried on the intermediary transfer belt 51 in a superposition manner. The clear toner image is formed on, e.g., a white portion of an image at which the background color of a recording material appears and eliminates a difference in glossiness from other full-color portions by covering the background of the recording material.

As shown in FIG. 3, when an instruction of the aging control is provided, the image forming apparatus 200 controls the image forming station Pe, so that toner bands GE of the clear toner are formed and then primary-transferred onto the intermediary transfer belt 51. This is because the backside contamination of the recording material is not conspicuous compared with the yellow toner even when the toner bands GE and transferred onto the backside of the recording material after image formation is started in a state in which the toner bands GE remain on the secondary transfer roller 57.

According to the present invention, in the case where the backside contamination attributable to the control images occurs or is liable to occur, control of a cleaning mode in which the cleaning toner image is formed and then is transferred onto the transfer member is executable. During the cleaning mode, by using the cleaning toner image, toner is applied over the entire circumferential surface of the transfer member through the image carrying member, so that the electric discharge product is moved from the surface of the recording material onto the toner. Then, the toner which carries the electric discharge product is collected from the surface of the transfer member by the transfer member cleaning device.

Further, during the cleaning mode, the toner is deposited on the entire circumferential surface of the image carrying member, so that movement of the electric discharge product from the image carrying member to the transfer member is suppressed.

In this case, the toner is concentratedly supplied to a portion contributing to the cleaning performance for the control images, so that the electric discharge product deposited at the portion contributing to the cleaning performance for the control images can be removed with less consumption of toner in amount. With respect to a direction perpendicular to the rotational direction of the image carrying member, the cleaning toner image is formed in an area which includes at least an area in which the control images are formed and which is narrower than a maximum image forming area. As a result, the electric discharge product is removed concentratedly in an area necessary for members concerning the cleaning performance for the control images, so that the toner can be saved in an area which is not associated with the cleaning performance for the control images.

Therefore, the cleaning performance of the transfer member cleaning device for the toner images for control is efficiently restored, so that the backside contamination of the recording material attributable to the control images and the like phenomenon can be alleviated.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 018727/2008 filed Jan. 30, 2008, which is hereby incorporated by reference.

What is claimed is:

1. An image forming apparatus, comprising:

an image carrying member;

toner image forming means, for forming a toner image on said image carrying member, capable of forming an adjusting toner image;

adjusting means for adjusting a toner image forming condition by detecting the adjusting toner image;

a transfer member, contactable to said image carrying member, for forming a transfer portion for transferring the toner image from said image carrying member onto a recording material;

a transfer power source for applying a voltage of an opposite polarity to a normal charge polarity of toner;

a brush cleaning member, contactable to said transfer member, for electrostatically removing toner on said transfer member; and an execution portion for executing a cleaning mode in which a cleaning toner image is formed in a length equal to or longer than a circumference of said transfer member and in an area including an area in which the adjusting toner image is formed with respect to a direction perpendicular to a movement direction of said image carrying member and then the cleaning toner image is transferred onto said transfer member by said transfer power source and then said brush cleaning member electrostatically removes the toner transferred on said transfer member.

2. An apparatus according to claim 1, wherein the cleaning toner image has a width smaller than a maximum image forming area width with respect to the direction perpendicular to the movement direction of said image carrying member.

3. An apparatus according to claim 1, wherein the cleaning toner image is continuously formed in a length equal to an integral multiple of the circumference of said transfer member.

4. An apparatus according to claim 1, wherein the cleaning toner image is intermittently formed at different positions for a plurality of rotations of said image carrying member in a rotational direction of said image carrying member.

5. An apparatus according to claim 1, further comprising a plurality of developing devices different in color of toner used, wherein the cleaning toner image is formed by using the developing device for toner having a smallest contrast with respect to the recording material.

6. An apparatus according to claim 1, wherein a length of the cleaning toner image formed in the cleaning mode is not less than a circumference of said image carrying member.

* * * * *